US008121847B2

(12) United States Patent
Klinke et al.

(10) Patent No.: US 8,121,847 B2
(45) Date of Patent: Feb. 21, 2012

(54) COMMUNICATION TERMINAL WITH A PARAMETERISED BANDWIDTH EXPANSION, AND METHOD FOR THE BANDWIDTH EXPANSION THEREOF

(75) Inventors: Stefano Ambrosius Klinke, Kerpen (DE); Frank Lorenz, Bocholt (DE)

(73) Assignee: Hewlett-Packard Development Company, L.P., Houston, TX (US)

( * ) Notice: Subject to any disclaimer, the term of this patent is extended or adjusted under 35 U.S.C. 154(b) by 423 days.

(21) Appl. No.: 10/534,327

(22) PCT Filed: Oct. 30, 2003

(86) PCT No.: PCT/DE03/03616

§ 371 (c)(1),
(2), (4) Date: May 9, 2005

(87) PCT Pub. No.: WO2004/042701

PCT Pub. Date: May 21, 2004

(65) Prior Publication Data

US 2006/0111150 A1 May 25, 2006

(30) Foreign Application Priority Data

Nov. 8, 2002 (DE) ..... 102 52 070

(51) Int. Cl.
*G10L 19/00* (2006.01)

(52) U.S. Cl. ..... 704/500; 704/266; 704/51; 704/502; 704/503; 704/504

(58) Field of Classification Search ..... 704/500–504
See application file for complete search history.

(56) References Cited

U.S. PATENT DOCUMENTS

| | | | | |
|---|---|---|---|---|
| 6,480,822 | B2 * | 11/2002 | Thyssen | 704/220 |
| 6,498,811 | B1 * | 12/2002 | Van Der Vleuten | 375/240 |
| 6,574,593 | B1 * | 6/2003 | Gao et al. | 704/222 |
| 6,615,169 | B1 * | 9/2003 | Vainio et al. | 704/205 |
| 6,691,083 | B1 * | 2/2004 | Breen | 704/220 |
| 6,691,092 | B1 * | 2/2004 | Udaya Bhaskar et al. | 704/265 |

(Continued)

FOREIGN PATENT DOCUMENTS

GB 2 357 682 6/2001

OTHER PUBLICATIONS

XP 010520066 "Wideband extension of telephone speech using a hidden markov model" IEEE Workshop on Speech Coding, Proceedings, Meeting the Challenges of the New Millennium, Sep. 17, 2000, pp. 133-135.

(Continued)

*Primary Examiner* — Leonard Saint Cyr

(57) ABSTRACT

The disclosure relates to a communication terminal having a bandwidth expansion device for expanding the bandwidth of a narrowband voice signal, on a low-frequency and/or high-frequency side, by synthesizing at least one frequency band on the basis of the narrowband voice signal. A qualitatively satisfactory bandwidth expansion is thus performed using a plurality of net bit rates. The bandwidth expansion device is further connected to a memory containing a lookup table comprising at least one parameter value for the bandwidth expansion, for at least two net bit rates of the narrowband voice signal. A method for expanding a bandwidth of a narrowband voice signal having at least two net bit rates in a communication terminal is also disclosed herein.

3 Claims, 1 Drawing Sheet

U.S. PATENT DOCUMENTS

| | | | | |
|---|---|---|---|---|
| 6,895,375 | B2 * | 5/2005 | Malah et al. | 704/219 |
| 6,988,066 | B2 * | 1/2006 | Malah | 704/219 |
| 7,181,402 | B2 * | 2/2007 | Jax et al. | 704/500 |
| 7,216,074 | B2 * | 5/2007 | Malah et al. | 704/205 |
| 2002/0147579 | A1 * | 10/2002 | Kushner et al. | 704/207 |
| 2003/0074192 | A1 * | 4/2003 | Choi et al. | 704/219 |
| 2003/0093279 | A1 * | 5/2003 | Malah et al. | 704/265 |
| 2004/0153313 | A1 * | 8/2004 | Aubauer et al. | 704/206 |

OTHER PUBLICATIONS

Manual for University Mobile Telecommunications System (UMTS); Mandatory Speech Codec speech processing functions AMR Wideband speech codec; Transcoding functions (3GPP TS 26.190 version 5.1.0 Release 5) published by European Telecommunications Standards Institute in Dec. 2001.

* cited by examiner

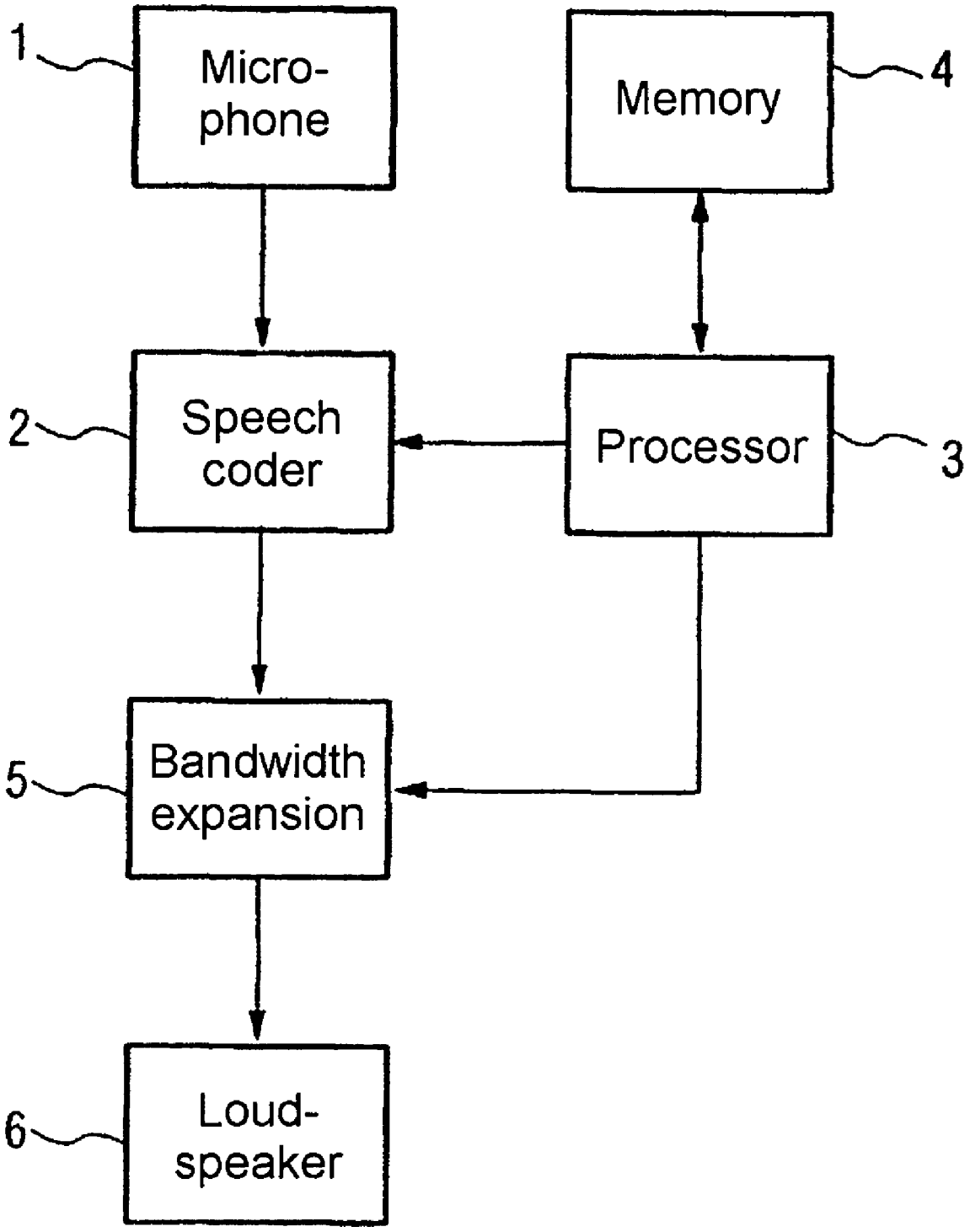
1
Micro-
phone
Memory
4
2
Speech
coder
Processor
3
5
Bandwidth
expansion
6
Loud-
speaker

COMMUNICATION TERMINAL WITH A PARAMETERISED BANDWIDTH EXPANSION, AND METHOD FOR THE BANDWIDTH EXPANSION THEREOF

FIELD OF TECHNOLOGY

The present disclosure relates to a communication terminal with a bandwidth expansion device for expansion of a bandwidth of a narrowband speech signal at its low-frequency and/or high-frequency end by synthesis of at least one frequency band on the basis of the narrowband speech signal.

BACKGROUND

For mobile telephones that are currently on the market, as examples of communication terminals, the relevant GSM Standard specifies that a standard net bit rate be used for the speech coder which carries out the function of coding of speech signals to form reduced-data narrowband speech signals, which are transmitted via a transmission output stage of the communication terminal. The GSM-specific net bit rate is 12.2 kbit/s, and relates generally to the widely used EFR Codec. Further developments of the EFR Codec have the aim, however, of making it possible to process different net bit rates for the speech coder. In this context, the NBAMR Codec ("Narrowband Adaptive Multirate") is commonly used which, overall, allows eight different net bit rates for operation of the speech coder, (4.75; 5.15; 5.9; 6.7; 7.4; 7.95; 10.2 and 12.2 kbit/s). In this case, the expectation from the lower net bit rates is that they will actually have advantages for comparatively poor radio transmission paths, since the transmitted signals can be provided with greater redundancy.

The measure of providing a communication terminal with a bandwidth expansion device which evaluates a narrowband speech signal (which has been received by the communication terminal) and synthesizes at least one further frequency band on the basis of the evaluation by means of a suitable algorithm is likewise known from the prior art. Normally, the currently used narrowband speech signal is in the frequency band between 300 Hz and 3.4 kHz. Additional frequency bands can be produced by synthesis both at the low-frequency end and at the high-frequency end of this frequency band, thus resulting in bandwidth expansion. Communication terminals such as this with bandwidth expansion have, however, so far been proposed only in conjunction with speech coders which operate at a single net bit rate.

BRIEF SUMMARY

Against this background, the present disclosure provides a communication terminal in which qualitatively satisfactory bandwidth expansion can be carried out even when using two or more net bit rates for the narrowband speech signal under an exemplary embodiment. A further embodiment discloses a method for expansion of a bandwidth of a narrowband speech signal for a communication terminal, which can be used with communication terminals which operate with two or more net bit rates for the narrowband speech signal.

The communication terminal is preferably equipped with a bandwidth expansion device for expansion of a bandwidth of a narrowband speech signal at its low-frequency and/or high-frequency end by synthesis of at least one frequency band on the basis of the narrowband speech signal. The bandwidth expansion device is also connected to a memory in which a reference table is stored, which in each case contains at least one parameter value for the bandwidth expansion for at least two net bit rates of the narrowband speech signal.

A memory that contains values that are suitable for the respectively used net bit rates for parameters which govern the quality of the bandwidth expansion is thus provided for the novel communication terminal. The optimum configuration for the bandwidth expansion may be dependent on which net bit rate is currently being used by a speech coder on which the received narrowband speech signal is based. The memory is provided for this reason and contains, for example, empirically determined values for the parameters, in which case auditory tests can in each case be carried out for the respective net bit rates.

Under one embodiment, the reference table that is stored in the memory takes account, as parameters for bandwidth expansion, of the energy in a synthesized frequency band and of a spectral structure of the synthesized frequency band. This means that the reference table is used to store, for a respective net bit rate, values which make it possible to deduce the energy in a synthesized frequency band, while a second parameter value defines the spectral structure of the synthesized frequency band.

As an example, the energy in a synthesized frequency band may be rather low when the net bit rate is comparatively low, since, in this case, the probability of artefacts occurring in the narrowband speech signal is rather high. Fundamentally, artefacts in the narrowband speech signal lead to errors in the synthesized frequency band, since the synthesis is based on evaluation of the narrowband speech signal. It may therefore be advantageous to keep the total energy in the synthesized frequency band low when the bit rate is low.

The probability of occurrence of artefacts can also be taken into account in terms of the spectral structure of the synthesized frequency band. Provided that these artefacts are localized sufficiently well within one frequency band of the narrowband speech signal, a low intensity can be provided in the synthesized frequency band for those frequencies which are based on frequency components in the narrowband speech signal that are subject to artefacts.

With regard to a method disclosed herein, performs expansion of the bandwidth of a narrowband speech signal for a communication terminal, having the following steps under an alternate embodiment:

a) detecting a net bit rate of the narrowband speech signal of the communication terminal, b) accepting a memory which contains a reference table which contains associations between at least two net bit rates and parameter values for bandwidth expansion, in order to determine the at least one parameter value which is suitable for the detected net bit rate.

c) expanding bandwidth by means of a bandwidth expansion device on the basis of the parameters determined for a current bit rate in step b).

This exemplary method takes account of the fact that, for example, over the course of a communication link, it is also possible for a change to occur from a first net bit rate to a second net bit rate for a speech coder which is producing the narrowband speech signal. For this reason, the current net bit rate of the speech coder is detected in the step a), so that the appropriate values for the parameters for bandwidth expansion can be found on the basis of this net bit rate in step b). The bandwidth expansion can then be carried out as well as possible in step c) on the basis of the results from step b).

BRIEF DESCRIPTION OF THE DRAWINGS

The various objects, advantages and novel features of the present disclosure will be more readily apprehended from the following Detailed Description when read in conjunction with the enclosed drawings, in which FIG. 1 illustrates a schematic block diagram of a communication terminal.

DETAILED DESCRIPTION

As can be seen from FIG. 1, speech signals in a mobile communication terminal pass on a transmission side from a microphone 1 to a speech coder 2 which is used for compression of the data transmission rate. The speech coder 2 operates on the basis of a "Linear Predictive Coding" (LPC) method, which simulates the process of creating a speech signal at the human speech rate. The speech coder 2 operates at various net bit rates, to be precise at that net bit rate which is defined on the network side for the transmitting communication terminal, and at the same time for a receiving mobile communication terminal. This definition covers both radio paths from the transmitting mobile communication terminal via the network structures that are involved to the receiving mobile communication terminal with which a communication link is to be set up. The net bit rate may, for example, change in the event of a deterioration occurring over the course of the communication link, such that it is reduced to a lower value.

On the network side, a processor 3 in the mobile communication terminal receives information on the net bit rate that is currently to be used for the link between the two mobile communication terminals. Depending on this information, the processor 3 accesses a memory 4 in which a reference table is stored, which contains all the possible net bit rates for the speech coder 2 and in each case includes associated values for at least the major parameters for bandwidth expansion, which is carried out by means of a bandwidth expansion device 5.

In practice, there are further functional components connected between the speech coder 2 at the transmission end and the bandwidth expansion device 5 at the receiving end which, inter alia, also carry out the radio transmission of the coded speech signals, although this is not illustrated in the FIGURE for clarity reasons.

The main parameters for bandwidth expansion are, for example, the total energy in an additional frequency band which is synthesized by means of a bandwidth expansion device 5 and is, for example, at the high-frequency end of the narrowband speech signal, which must be passed back to the speech coder 2. A further parameter is the spectral distribution of the intensities in the synthesized frequency band.

Both the main parameters which have been mentioned for bandwidth expansion take account of the fact that artefacts may in fact occur at low bit rates in the narrowband speech signal and affect the synthesized frequency band, as well, in the course of the bandwidth expansion process. In general, it can be assumed that the probability of artefacts in the narrowband speech signal is rather high at a low bit rate. Against this background, when the bit rates are low, not only is the total energy in the synthesized frequency band low, but the synthesized frequency band is also spectrally weighted such that frequency intervals are weighted as being low for which there is a high probability of the presence of artefacts in the associated frequency interval in the narrowband frequency band of the speech signal.

An output signal from the bandwidth expansion device 5 which comprises both the narrowband speech signal and a synthesized frequency band resulting from the bandwidth expansion is passed to a loudspeaker 6, via which speech signals are emitted.

The above described description and drawings are only to be considered illustrative of exemplary embodiments, which achieve the features and advantages of the invention. Modifications and substitutions to specific process conditions and structures can be made without departing from the spirit and scope of the invention. Accordingly, the invention is not to be considered as being limited by the foregoing description and drawings, but is only limited by the scope of the appended claims.

The invention claimed is:

1. A communication device, comprising:

a bandwidth expansion device for expanding a bandwidth of a narrowband speech signal at its low-frequency and/or high-frequency end by synthesis of at least one frequency band contained within said narrowband speech signal, the narrowband speech signal having at least two net bit rates; and a memory unit, communicatively coupled to said bandwidth expansion device, wherein said memory unit stores a reference table that includes at least one parameter value used for the bandwidth expansion for the at least two net bit rates of the narrowband speech signal, wherein the reference table takes account, as parameters, of an amount of energy in a synthesized frequency band and of a spectral structure of the synthesized frequency band, and wherein the spectral structure of the synthesized frequency band takes account of a probability of occurrences of artifacts at specific frequencies in the narrowband speech signal.

2. A method for expanding a bandwidth of a narrowband speech signal for a communication terminal, the method comprising:

a) detecting a net bit rate of the narrowband speech signal for the communication terminal;

accessing a memory that includes a reference table, the reference table including associations between at least two net bit rates and parameter values used for bandwidth expansion, in order to determine the at least one parameter value which is suitable for the detected net bit rate, wherein the reference table takes account, as parameters, of an amount of energy of a synthesized frequency band, and a spectral structure of the synthesized frequency band, and wherein the spectral structure of the synthesized frequency band takes account of a probability of occurrences of artifacts at specific frequencies in the narrowband speech signal; and c) expanding the bandwidth by means of a bandwidth expansion device on the basis of the parameters determined for the detected net bit rate in step b).

3. The method according to claim 2, wherein the amount of energy of the synthesized frequency band decreases as the net bit rate decreases.

* * * * *